US006082433A

United States Patent [19]

Vafaie et al.

[11] Patent Number: 6,082,433

[45] Date of Patent: Jul. 4, 2000

[54] CONTROL SYSTEM AND METHOD FOR ROLL-UP DOOR

[75] Inventors: Foad Vafaie, Plano; John J. Davis, Fort Worth; James A. Smith, Dallas, all of Tex.

[73] Assignee: Overhead Door Corporation, Dallas, Tex.

[21] Appl. No.: 08/976,071

[22] Filed: Nov. 21, 1997

[51] Int. Cl.[7] ..... A47G 5/02

[52] U.S. Cl. ..... 160/310; 160/8

[58] Field of Search ..... 160/310, 188, 160/1, 7, 8, 293.1, 291; 49/26

[56] References Cited

U.S. PATENT DOCUMENTS

| | | | |
|---|---|---|---|
| 4,296,791 | 10/1981 | Chaumat et al. . | |
| 4,651,940 | 3/1987 | Nakamura | 242/55 |
| 4,665,965 | 5/1987 | Pasquier et al. | 160/310 |
| 5,198,974 | 3/1993 | Orsat | 364/167.01 |
| 5,353,859 | 10/1994 | Oltahfer et al. | 160/310 |
| 5,601,133 | 2/1997 | Krupke et al. | 160/265 |
| 5,758,705 | 6/1998 | Wagner et al. | 160/310 |

*Primary Examiner*—Blair M. Johnson

*Attorney, Agent, or Firm*—Akin, Gump, Strauss, Hauer & Feld, LLP

[57] ABSTRACT

A flexible curtain rollup door is driven between open and closed positions by an adjustable frequency AC electric drive motor including a controller which is operable to accelerate and decelerate the motor by supplying AC electrical power at variable frequencies over a predetermined time period and for operating the motor at selected speeds during a continuous run phase of operation. A programmable logic controller (PLC) is operably connected to the controller for the drive motor and is operable to receive signals from upper and lower door position sensors, door bottom edge bar breakout sensors, a door bottom edge bar contact sensor, area sensors on one or both sides of the door for detecting the presence of an object within certain areas adjacent the door opening and manually operable switches to control opening and closing movements of the door. A position sensor is connected to the motor and generates signals correlated with motor and curtain roll drum revolutions to provide backup door position signals. An operating setup procedure includes teaching the PLC signals corresponding to the open and closed positions of the door to provide backup motor shutoff signals in the event that the door position or bottom bar breakout sensors fail to effect shutoff of the drive motor.

16 Claims, 9 Drawing Sheets

230 VOLTS
3ø 60 HZ
CB1
15 AMP
513
503
504
505
408
409
410
POWER TO AFD
503b
505b
FU1-2
AGC 3
514
CR3-1
L1A
L1B
L1C
SURGE SUPPRESSOR 600V
BRAKE
CR3-2
L3A
L3B
515
L3C
FU3-4
AGC 1
L1C
308
POWER TO PLC
L3C
310
230 VAC
516
FU5
AGC2
24H
+24
-24
POWER SUPPLY UNIT
24VDC 1.2 AMP
RESET
READ SETUP
526
527 CR-READ
CONTROL RELAY #1
"READ SETUP"
(138,140)
CR-READ
24A
228
TO PLC INPUTS
527a
CR-READ
12
205
TO INPUT 2 OF PLC
527b
450
TO DIP SWITCH
536
CONTROL RELAY #2
"LOOP ACTUATOR" (220)
201

CONTROL SYSTEM AND METHOD FOR ROLL-UP DOOR

FIELD OF THE INVENTION

The present invention pertains to an electrical control system for controlling the operation of a flexible curtain rollup type industrial door driven by an AC variable frequency drive motor for opening and closing the door.

BACKGROUND

Flexible curtain rollup type doors are used in many industrial applications as barriers between the interior of a building and the exterior or between adjacent rooms in a building. It is desirable, depending on door location factors and use, to operate flexible curtain rollup type doors more or less manually, that is by actuating a door opening switch and a door closing switch, as well as by remote control. Moreover, there are instances when it is desirable to operate such doors automatically on a predetermined time schedule. Accordingly, such doors desirably include a relatively complex control system for controlling the door in various operating modes and for preventing operation of the door in the event of unwanted operating conditions.

Flexible curtain rollup type doors can benefit from the development of variable voltage—variable frequency alternating current (AC) drive motors and controls therefor, sometimes known as adjustable frequency drive (AFD) systems. Such motors and associated controllers provide for easy speed adjustment through changing frequency of the applied electrical energy. The use of this type of drive system for controlling a flexible curtain rollup type door provides for operating the door under positive control at all times, while also providing for rapid open and closing movement. Moreover, the use of variable frequency AC motor drives also provides for controlling the door to undergo so-called soft start and soft stop movement to thereby reduce stresses on the door structure and related components. Still further, it is desirable in the manufacture of flexible curtain rollup type doors to be able to provide a control system which will operate doors of various sizes and curtain thicknesses and weights. In this regard the need to maintain an inventory of various mutlispeed motors for driving the doors can be substantially reduced or eliminated.

There has also been a desire in the application of rollup type doors to be able to interface the door controls with other systems in large manufacturing and warehouse facilities, for example. Still further, there has been a desire to provide for the ability to interlock spaced apart doors in applications requiring a so-called airlock, for example.

There has also been a desire and need in the art of rollup type doors to reduce the door installation time and procedure, to provide suitable controls which prevent damage to the door during rollup and roll down movement and to provide for stopping the door in the event that the door curtain is inadvertently or accidentally displaced from its guide tracks due to, for example, excessive wind loads or the door being struck by a vehicle or person moving toward or through the doorway. In this regard also there is a desire and need to provide for controlling the operation of the door after the door has broken out of its guide tracks and during reinstallation of the door curtain and its bottom bar within the guide tracks. The needs and desiderata mentioned herein, as well as other needs and desiderata which will become apparent to those skilled in the art upon reading the following summary and detailed description, have been substantially met by the invention described herein.

SUMMARY OF THE INVENTION

The present invention provides an improved control system and method for a flexible curtain rollup type door for controlling opening and closing movement of the door. The present invention also provides an improved rollup type door controlled by a variable frequency AC electric motor and associated controller.

In accordance with an important aspect of the invention a control system for a rollup type door is provided which includes a controller operable in conjunction with a plurality of door sensor devices which operate to control starting and/or stopping of the door drive motor in response to "learning" the open and closed positions of the door, in response to sensing such open and closed positions, in response to sensing an obstruction in the vicinity of the door and in response to an obstruction in the doorway. The control system for the rollup door of the present invention also provides for operating the door during starting and stopping periods under controlled acceleration and deceleration to provide for so-called soft starts and soft stops to thereby minimize the stresses on the door structure and associated operating components.

In accordance with another aspect of the present invention a control system for a rollup type door is provided which is operable to automatically close the door after the door is open for a predetermined time period. The control system is also adapted to operate a door closing warning signal prior to energization of the door drive motor to effect a closing movement of the door.

In accordance with a further aspect of the present invention the control system is operable to cease operation of a door in the event that the door bottom edge bar "breakout" bar is displaced from the door guide channels. The control system also allows for a manual door closing switch to be operated to position the door for reconnection of the door bottom bar with associated latch members which are disposed in the door side guide channels.

The present invention still further provides a control system for a rollup door which is operable to control operation of the door in response to a control signal from a remotely mounted switch, a vehicle proximity sensor or any other remote signal for operating the door to move between open and closed positions.

In accordance with yet a further aspect of the present invention an improved control system for a rollup type door is provided which comprises a programmable logic controller (PLC) operable in conjunction with a plurality of door condition sensors and adapted for controlling an adjustable frequency AC drive motor unit for operating the door to move between open and closed positions.

The improved control system for a rollup type door and method for controlling such a door in accordance with the invention, including further aspects thereof, will be further appreciated by those skilled in the art upon reading the detailed description which follows in conjunction with the drawing.

DESCRIPTION OF A PREFERRED EMBODIMENT

Figure 1:
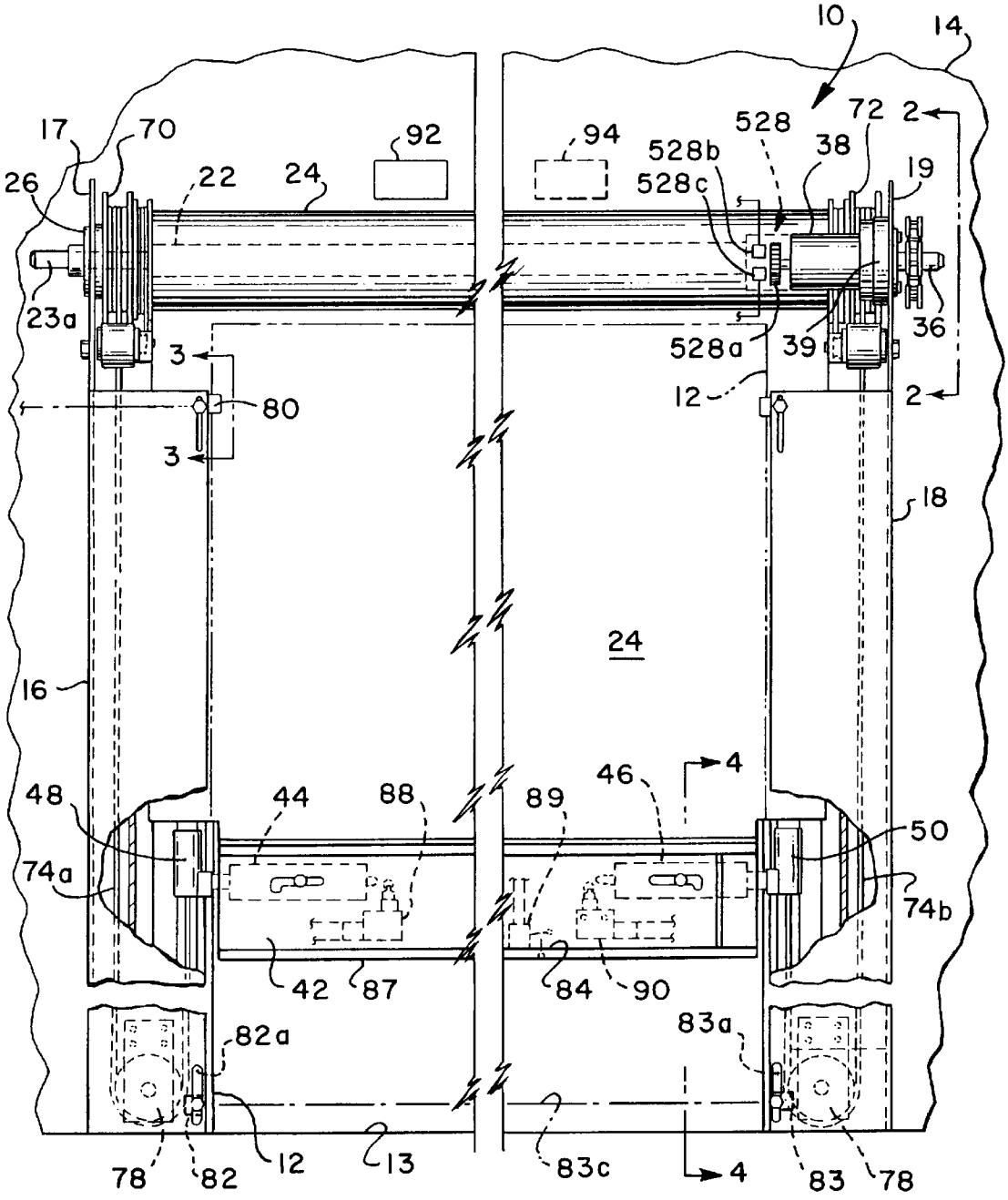
FIG. 1 is a front elevation of a rollup type door operated in conjunction with a control system in accordance with the present invention.

In the description which follows like elements are marked through the specification and drawing with the same reference numerals, respectively. The drawing figures are not intended to be to scale and certain elements may be shown in schematic or generalized form in the interest of clarity and conciseness.

Referring to FIG. 1, there is illustrated a rollup type door useful in conjunction with the control system of the present invention and generally designated by the numeral 10. The door 10 is adapted to be mounted at an opening 12 in a generally vertical wall 14 to provide a closure over the opening. The door 10 is characterized by a frame comprising spaced apart vertically extending door guide channels 16 and 18 which, respectively, include support plates 17 and 19 formed thereon, respectively, for supporting a rotatable curtain drum. The guide channels 16 and 18 are adapted to be supported at the wall 14 in a conventional manner. The support plates 17 and 19 are operable to support a rotatable door curtain drum 22 for rotation to unroll and rollup a generally flexible door closure member or curtain 24. The roller or drum 22 includes opposed trunnions or coaxial stub shaft parts 23*a* and 23*b* mounted in suitable bearings 26 disposed on the respective support plates 17 and 19, see FIG. 2 also. Specifically, a detachable support plate part 19*a* is connected to plate 19 and directly supports shaft part 23*b*. Shaft part 23*b* is drivenly connected to a suitable drive sprocket 30, see FIG. 2, over which is trained a flexible drive chain 32. Drive chain 32 is also meshed with a drive sprocket 34, FIG. 2, supported on an output shaft 36 of a variable frequency AC electric motor 38 suitably mounted on plate 19*a*. The motor 38 and an associated motor controller therefor may be of a type commercially available. An example of a suitable motor and associated motor controller will be described in further detail herein.

Figure 2:
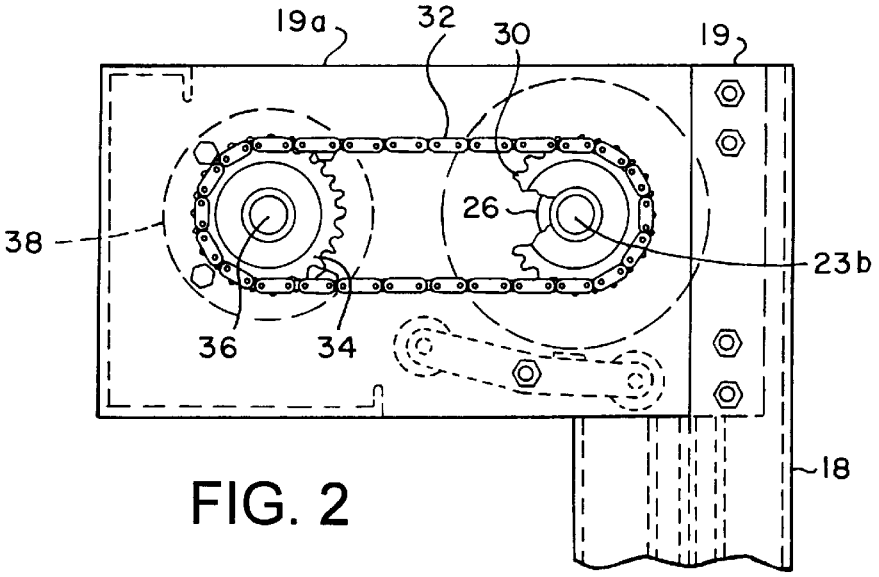
FIG. 2 is a detail view taking generally from the line 2—2 of the FIG. 1.

Referring further to FIGS. 1 and 2, and FIG. 1 in particular, door closure member 24 is adapted to move between open and closed positions within the opposed guide channels 16 and 18 and is operably connected to a substantially rigid so-called bottom breakout bar 42. Breakout bar 42 includes opposed retractable latch members 44 and 46 supported thereon and operable to engage latch receiving members 48 and 50, respectively, which are suitably supported for sliding movement in the opposed guide channels 16 and 18. The latch receiving members 48 and 50 are connected to one end of elongated flexible cables 74*a* and 74*b*, respectively. The cables 74*a* and 74*b* are trained over pulleys 78 supported at the bottom edges of the opposed guide channels 16 and 18 and the cables 74*a* and 74*b* are also trained over cable drums 70 and 72 mounted on and rotatable with the door take-up roller or drum 22. The cable drums 70 and 72 may be connected to suitable counterbalance springs, not shown, to effect a counterbalance force on the cables 74*a* and 74*b* to tension these cables and to exert a pull down force on the door closure member or curtain 24 through the aforementioned latch members in opposition to a force tending to rotate the drum 22 to roll the curtain 24 onto the drum in the same manner as the roller of a conventional window shade or the like.

Further details of the structural features of the door 10 are not believed to be necessary for practicing the present invention. An exemplary door which may be used in conjunction with the control system of the present invention is described and claimed in U.S. Pat. No. 5,601,133, issued Feb. 11, 1997 to LeRoy G. Krupke et al and assigned to the assignee of the present invention. U.S. Pat. No. 5,601,133 is incorporated by reference in this application.

Figure 3:
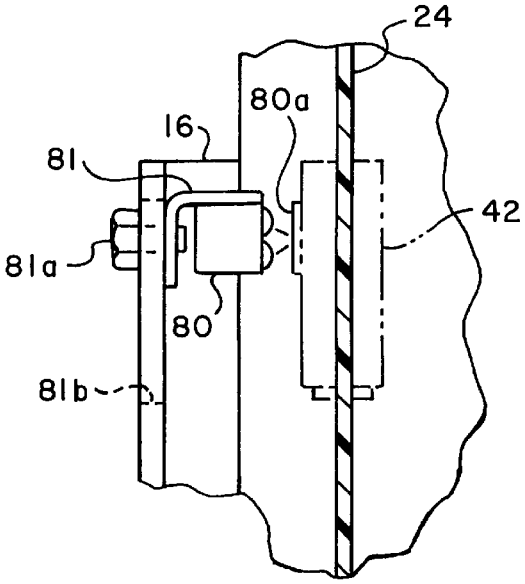
FIG. 3 is a detail view taken from the line 3—3 of FIG. 1.

Referring further to FIG. 1, the door 10 also includes closure member position sensors 80 and 82, 83 suitably mounted on the door frame members 16 and 18 and operable to generate suitable electrical signals in response to movement of the door closure member to an open position, sensed by position sensor 80, and a closed position, sensed by position sensor 82, 83. The position sensors 80 and 82, 83 may be suitable proximity sensors or photoelectric type sensors. Referring also to FIG. 3, one preferred embodiment of the position sensor 80 is shown mounted on a suitable bracket 81 by conventional fastener means 81*a* projecting through an elongated slot 81*b* formed in guide channel 16 so that the vertical position of the sensor 80 may be adjusted, at will. The sensor 80 is preferably a photoelectric type and, specifically, of a type which is operable to emit a beam of radiation which is reflected off of a suitable reflector 80*a* mounted on the breakout bar 42, for example. Accordingly, when the door closure member 24 is moving toward the open position, a radiation beam emitted by the sensor 80 will be reflected back to receiver means of sensor 80 in the presence of the breakout bar 42 and generate a suitable control signal to the control system to be described in further detail herein.

Figure 4:
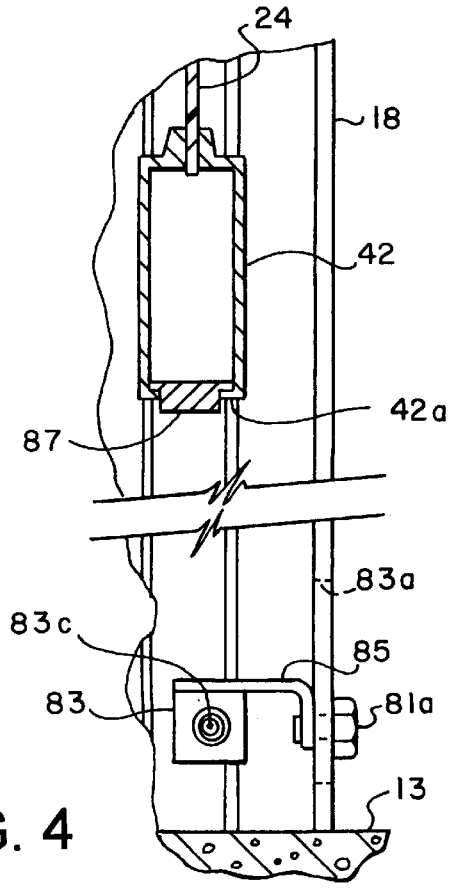
FIG. 4 is a detail view taken generally from the line 4—4 of FIG. 1.

Referring further to FIG. 1, and FIG. 4, the sensor 82, 83 is also preferably of the photoelectric type and is also mounted on suitable bracket means, not shown in FIG. 1 so that the vertical position of the sensor 82 may be adjusted along a slot 82*a* formed in the guide channel 16 at a position on the channel near the bottom edge thereof and adjacent a floor 13, for example. In the arrangement shown in FIGS. 1 and 3, the sensor 82 is a radiation beam transmitter and is arranged to transmit a beam across the width of the opening 12 toward a receiver element 83 also mounted for vertical adjustment on the guide channel 18, thanks to the provision of a suitable vertically extending slot 83*a* formed therein, FIG. 1. As shown in FIG. 4, the radiation beam receiver 83 is mounted on a suitable bracket 85 for adjustment of its position on the guide rail 18. The sensor transmitter and receiver combination of the sensor 82, 83 is also positioned on the guide channels 16 and 18 such that when the closure member or breakout bar 42 reaches the floor 13 a radiation beam 83*c*, FIG. 1, being transmitted across the opening 12 is interrupted and a suitable electrical signal is generated for use by the control system of the present invention. Moreover, if an obstruction appears in the opening 12 when the closure member 24 is in the door open position, the aforementioned radiation beam will also be interrupted and the resulting control signal may be utilized to prevent closure of the door. In this way, the sensor 82, 83 not only serves to determine the position of the door closure member approaching the floor 13 for use in controlling the motor 38, but also to provide an obstruction detection signal for the control system to prevent, for example, movement of the closure member or curtain 24 toward the door closed position. In any event, the sensors 80 and 82, 83 are operable to generate suitable electrical signals in response to the door closure member 24 moving to an open position and a closed position, respectively.

The door 10 is also adapted to include a bottom edge sensor 84 mounted on the breakout bar 42 and operable to generate a suitable electrical signal in response to engaging an obstruction in the doorway 12. In particular, the bottom edge sensor 84 includes, for example, an elongated movable plate member 87, see FIG. 4 also, which is mounted on the breakout bar 42 for movement relative to the bottom edge 42*a* of the breakout bar and to activate a suitable switch 89, FIG. 1, on the breakout bar to generate a suitable electrical signal. The plate member 87 may be biased by suitable spring means, not shown, into a position out of engagement with the switch 89 and is also responsive to engaging an obstruction in the doorway 12 to actuate switch 89. Other types of bottom edge sensors may be used in place of the aforementioned device, which is exemplary.

Still further, the breakout bar 42 includes spaced apart switches 88 and 90 suitably mounted thereon, FIG. 1, and operable to sense movement of the latch members 44 and 46, respectively, to disengage from the latch receiving members 48 and 50 in response to, for example, the closure member 24 being struck by a vehicle, such as a material handling truck, or by a person attempting to move through the door in the closed position thereof In any event, if the latch members 44 and/or 46 move to disengage from the latch receiving members 48 and/or 50 the switches 88 and/or 90 will generate a suitable signal for the control system to be explained in further detail herein. Signal conductors for the switches 88, 89 and 90, not shown, may be trained along one side of the closure member 24 within one of the guide channels 16 or 18, and secured to the bottom bar 42, but trained loosely in the manner of an umbilical, for example, so that signals generated by these switches may be transmitted to the aforementioned control system in any position of the closure member 24. An enclosure for the subject control system is preferably mounted in the vicinity of the door on the wall 14 or on another suitable structural member whereby the control system may be easily operated and serviced as needed.

Referring further to FIG. 1, the door 10 may also be provided with suitable area sensors 92 and 94, mounted in positions above doorway 12, on opposite sides of wall 14, for example, for sensing the presence of an obstruction in the vicinity of the doorway. The sensors 92 and 94 may be ones of various types, such as infrared radiation beam detection or ultrasonic beam reflection devices, which are capable of generating signals upon sensing the presence of an obstruction on either side of the doorway 12, respectively.

Referring still further to FIG. 1, the variable frequency AC electric motor 38 includes a suitable electromechanical brake mechanism 39 mounted in conjunction with the motor and operably connected to shaft 36 to effect a braking action or a locking action on the shaft 36 in response to a suitable control signal applied thereto. By way of example the motor 38 and an associated controller described hereinbelow may comprise an adjustable frequency drive unit manufactured by MagneTek Corporation as their model GPD 205.

Figure 5A:
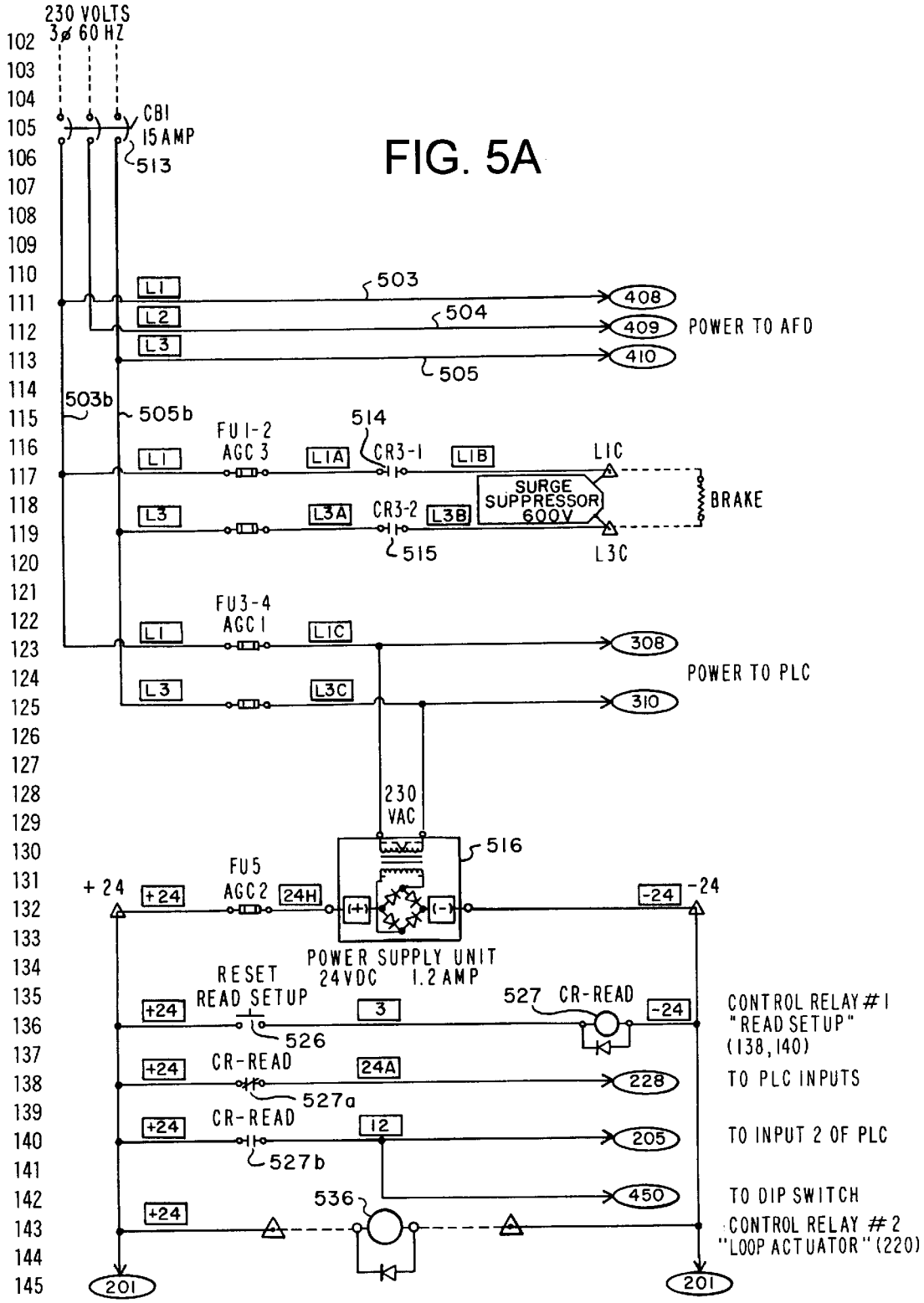
FIGS. 5A through 5G comprise a schematic diagram of the control system of the present invention.
Figure 5B:
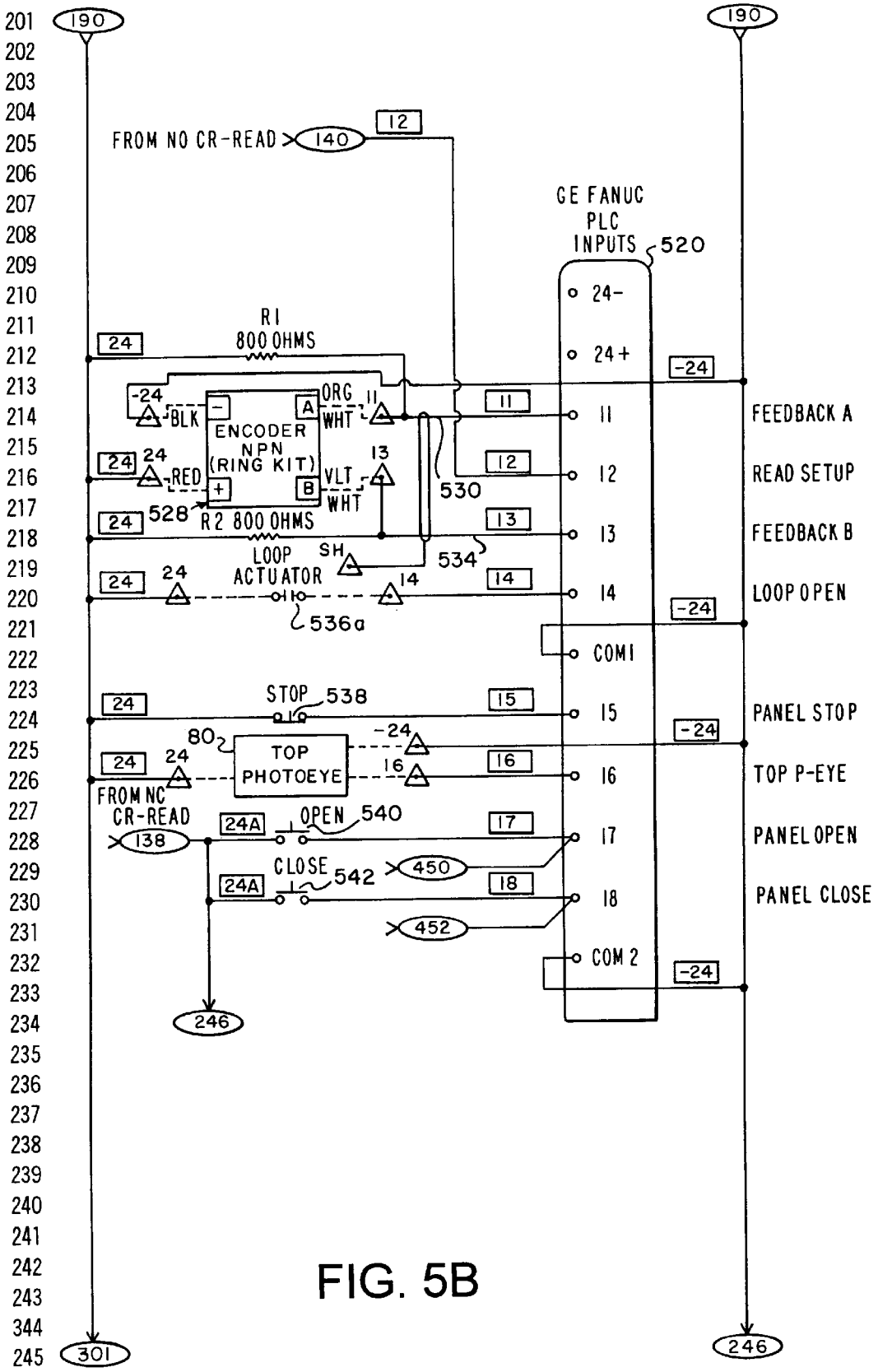
Figure 5C:
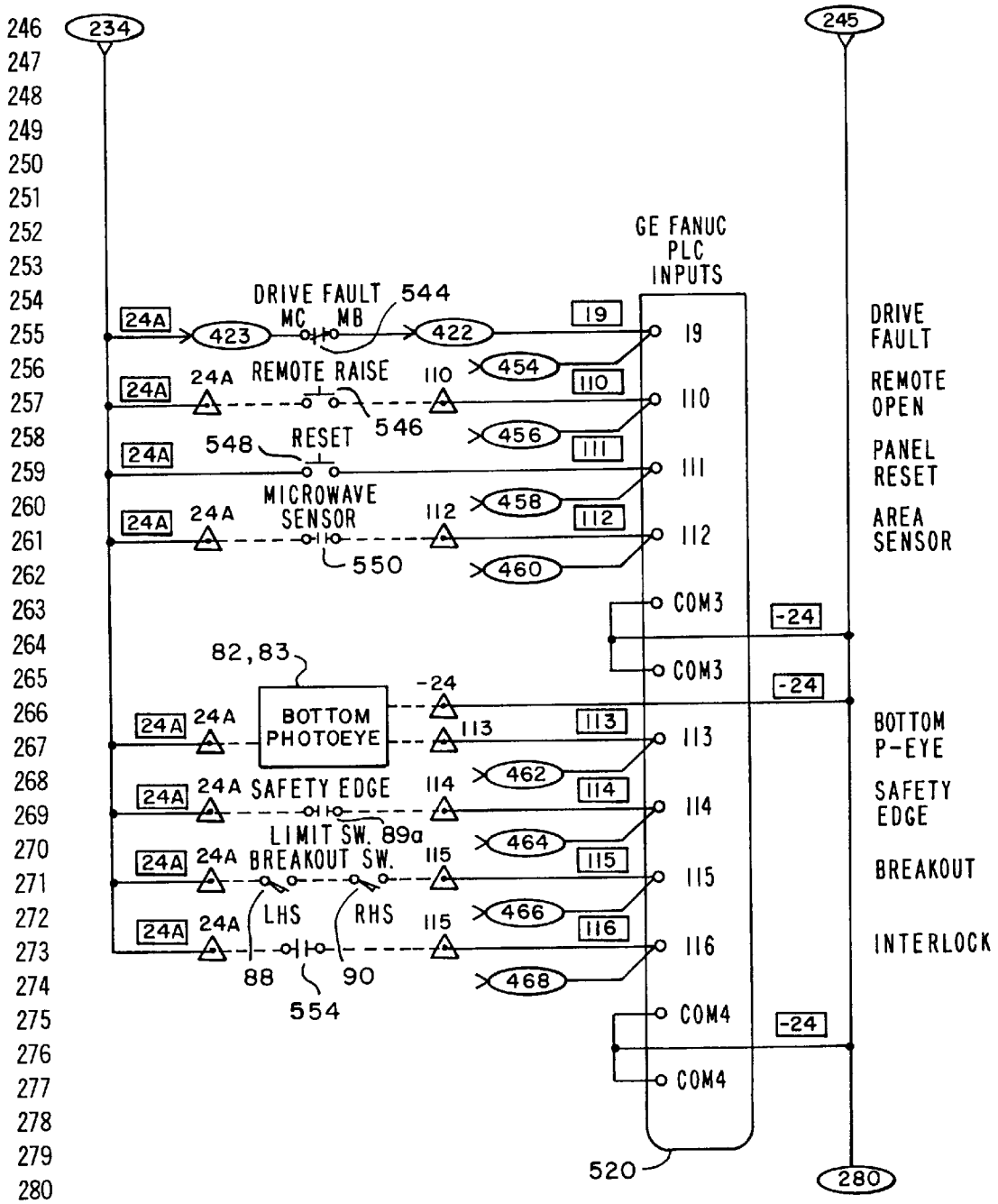
Figure 5D:
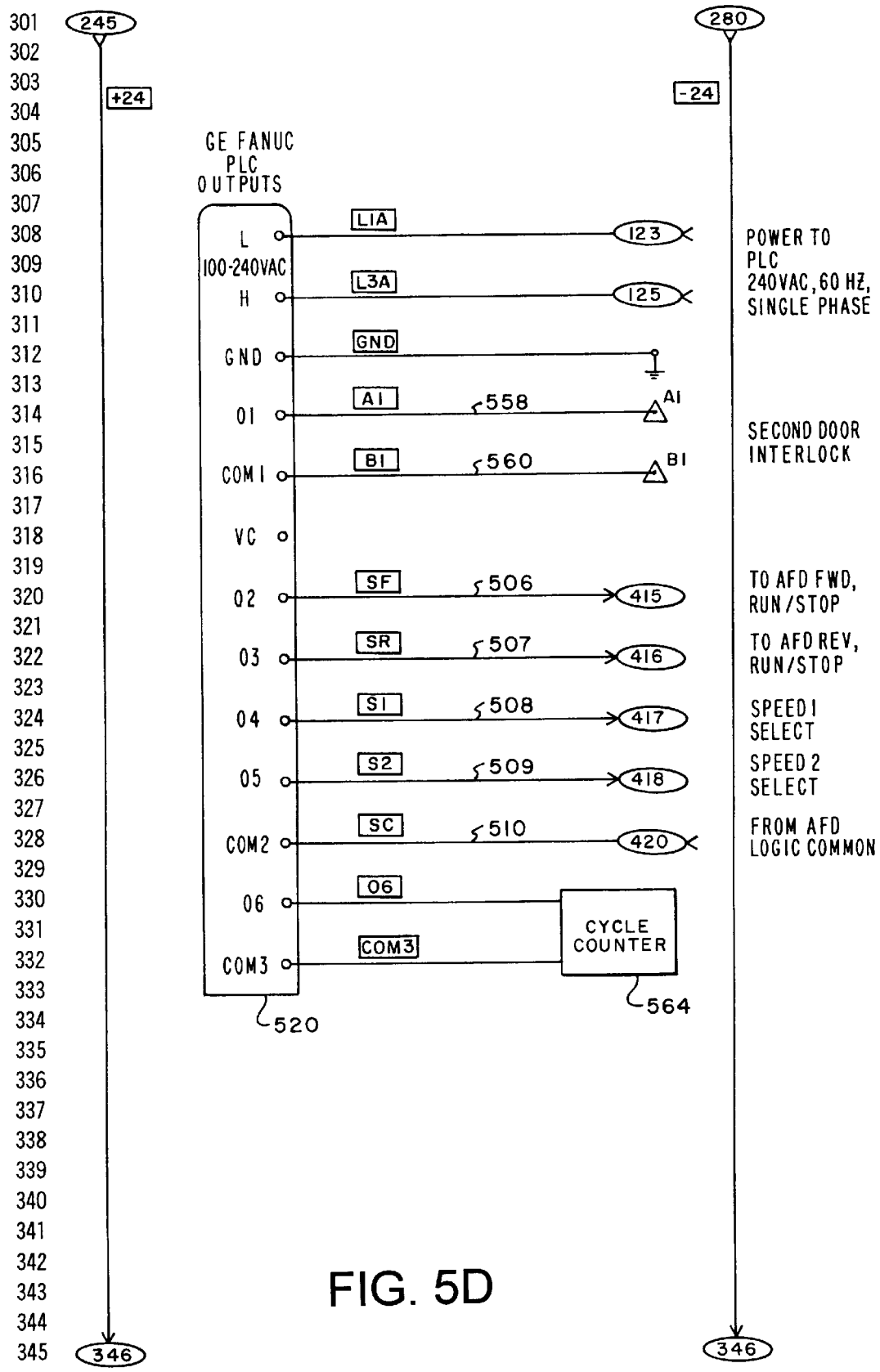
Figure 5E:
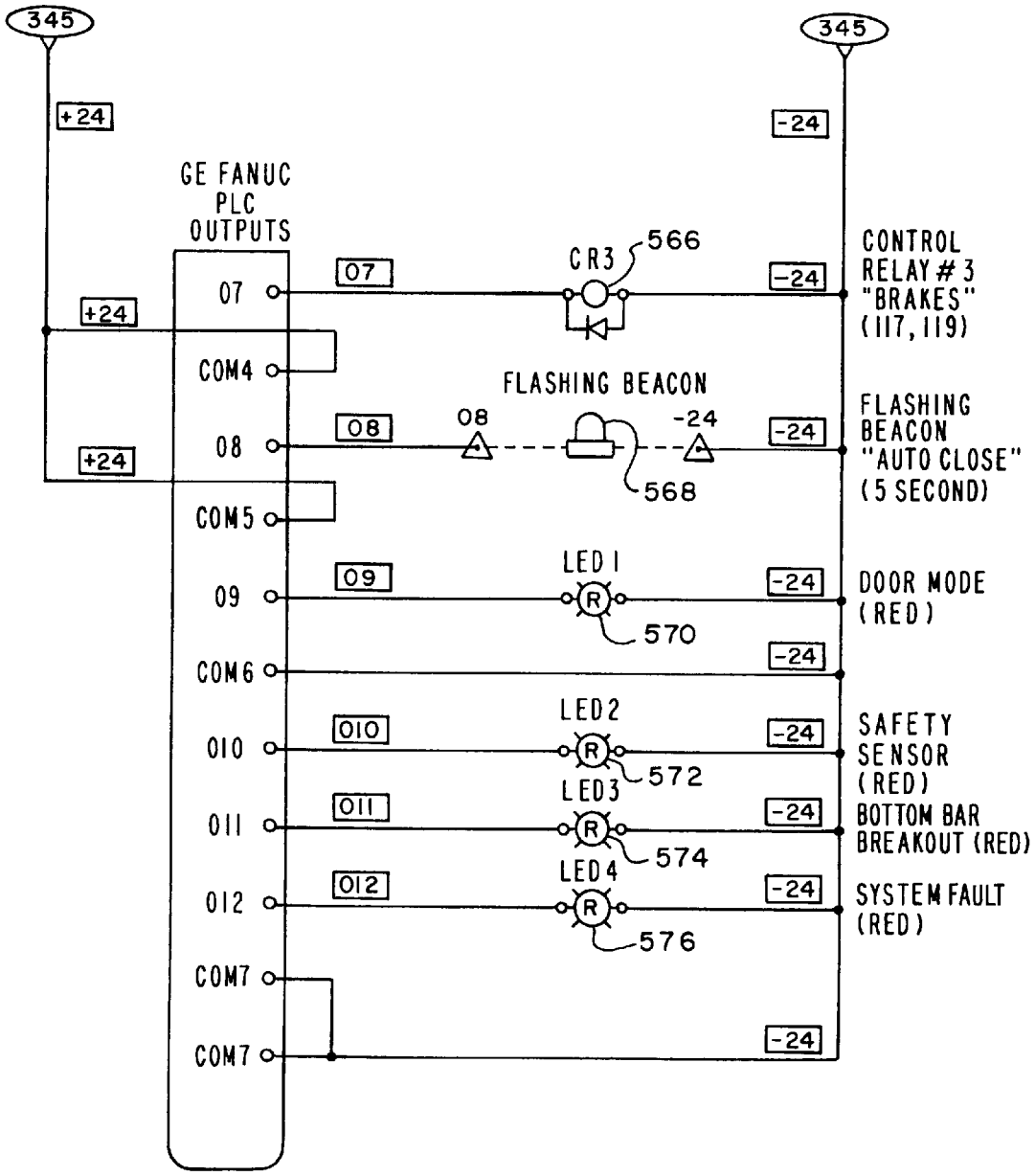
Figure 5F:
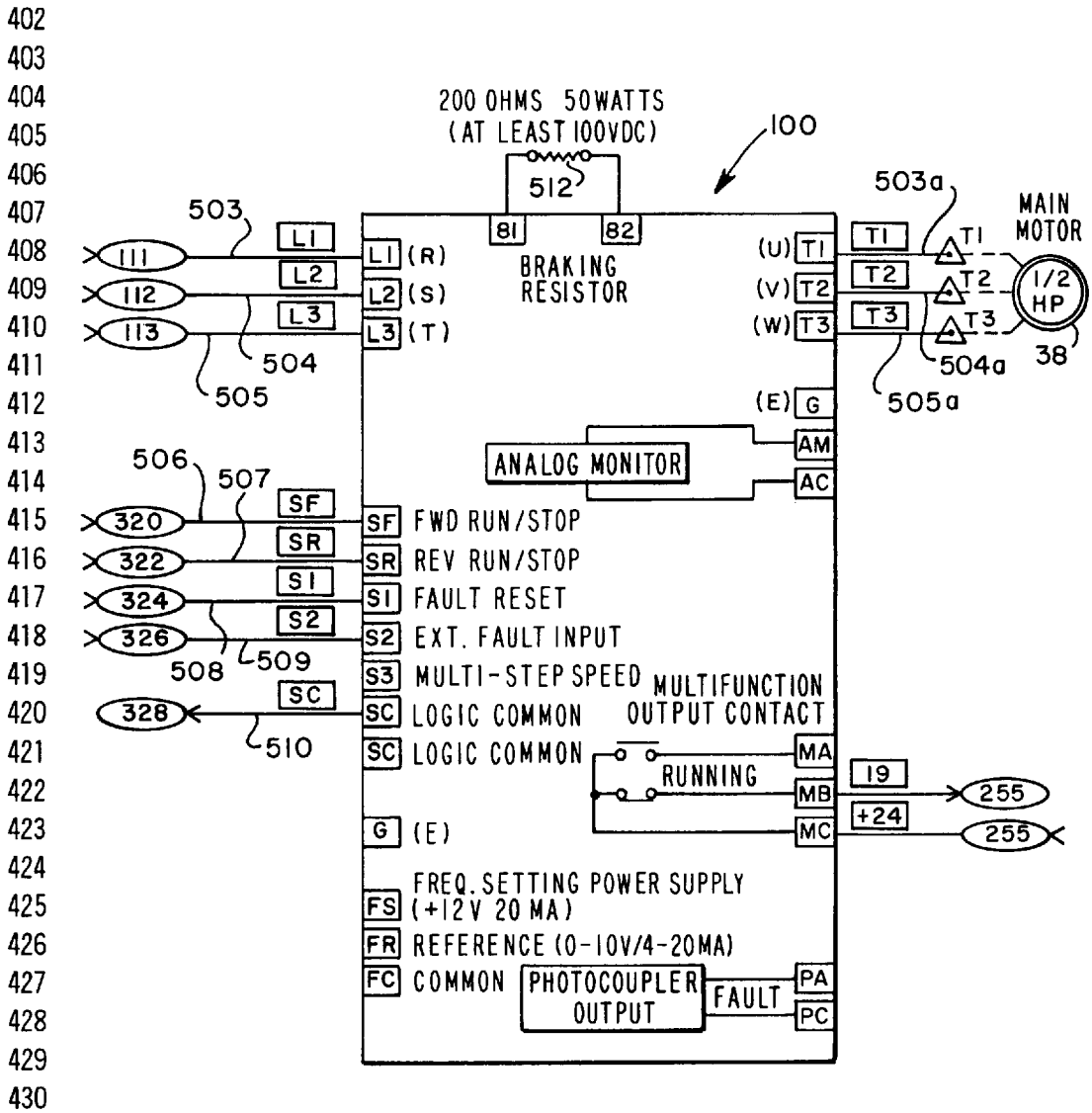

Referring now to FIGS. 5A through 5G, there is illustrated a circuit diagram wherein each portion of the diagram shown in FIGS. 5A through 5G, respectively, includes vertical columns of numbers adjacent respective conductor elements and also indicating the connection point of the conductor element on another figure of the diagram by an appropriate line number disposed within an oval. Referring first to FIG. 5F, the variable frequency motor 38 includes and is operated by a suitable adjustable frequency drive (AFD) motor controller, generally designated by the numeral 100, which is operably connected to a source of three phrase AC electric power by way of conductors 503, 504 and 505 suitably connected to the controller. Conductors 503*a*, 504*a* and 505*a* lead from the controller 100 to the motor 38. The controller 100 is also operable to receive suitable command signals by way of conductors 506, 507, 508, 509 and 510 to command the controller to run the motor 38 in opposite directions, to reset a motor fault condition and to stop the motor in response to an external fault input, for example. The controller 100 also includes suitable controls for setting the motor operating frequencies and speeds in response to receiving signals to run in the forward and reverse directions and to provide variable frequency starting and stopping cycles for the motor 38. Accordingly, the motor 38 may be driven during a starting phase and stopping phase at variable AC power frequencies to provide for a variable speed "soft" start or acceleration and a variable speed deceleration or "soft" stop operating cycle. Moreover, a steady state operating speed of the motor 38 between the variable speed start and stop cycles may, in one direction of rotation, be selected to be different from the steady state operating speed in the opposite direction. In this way the flexible closure member 24 may be opened and closed at selected speeds to accommodate particular applications of the rollup door 10. Also, by varying the speed of the motor 38 during starting and stopping, reduced stresses on the closure member 24 and other working components of the door 10 may be enjoyed.

Referring further to FIG. 5F, the diagram of the controller 100 indicates that a braking resistor 512 is suitably interposed in circuit with the motor 38 and is operable to dissipate a back EMF generated by the motor during deceleration thereof by acting as a resistive load to the generated EMF. The capacity of the braking resistor 512 may be preselected in accordance with the amount of energy to be dissipated which may, at least in part, be dependent on the expected momentum of the closure member 24 and its associated elements including the support roller or drum 22. The dynamic braking of motor 38 is thus automatic and is not controlled by any other remote signal. Again, in this way the door closure member 24 may be brought to a smooth stop without imposing stresses thereon or on a mechanical type brake mechanism. Further discussion of the controller 100 with respect to the selection of operating speed, soft start acceleration time and motor operating frequencies and soft stop deceleration time and motor operating frequencies will not be set forth in detail herein, as these parameters are selected in accordance with known practice for operating a variable frequency drive unit, such as the motor 38, for other motor applications.

Referring to FIG. 5A, conductors 503, 504 and 505 are connected to a suitable source of three phase AC electric power, not shown, by way of a circuit breaker 513. Conductors 503*b* and 505*b* are also connected to suitable conductors for energizing and deenergizing the brake 39 by way of suitable relay contacts 514 and 515. Conductors 503*b* and 505*b* are also suitably connected to a rectifier unit 516 for providing twenty-four volt DC power to additional circuit elements to be described herein. Conductors 503*b* and 505*b* are also operably connected to input terminals for a programmable logic controller (PLC) 520, see FIG. 5D. Portions of the terminal boards for the PLC 520 are shown in FIGS. 5B through 5E, as indicated by the respective terminals shown thereon. The programmable logic controller (PLC) 520 is preferably of a type commercially available, such as from General Electric Company as their series 90-30/20 Micro. The PLC 520 is operable in response to receiving certain input signals at terminals identified on the diagram from components described herein and from suitable programming to carryout the operation of the door 10, as described.

Figure 5G:
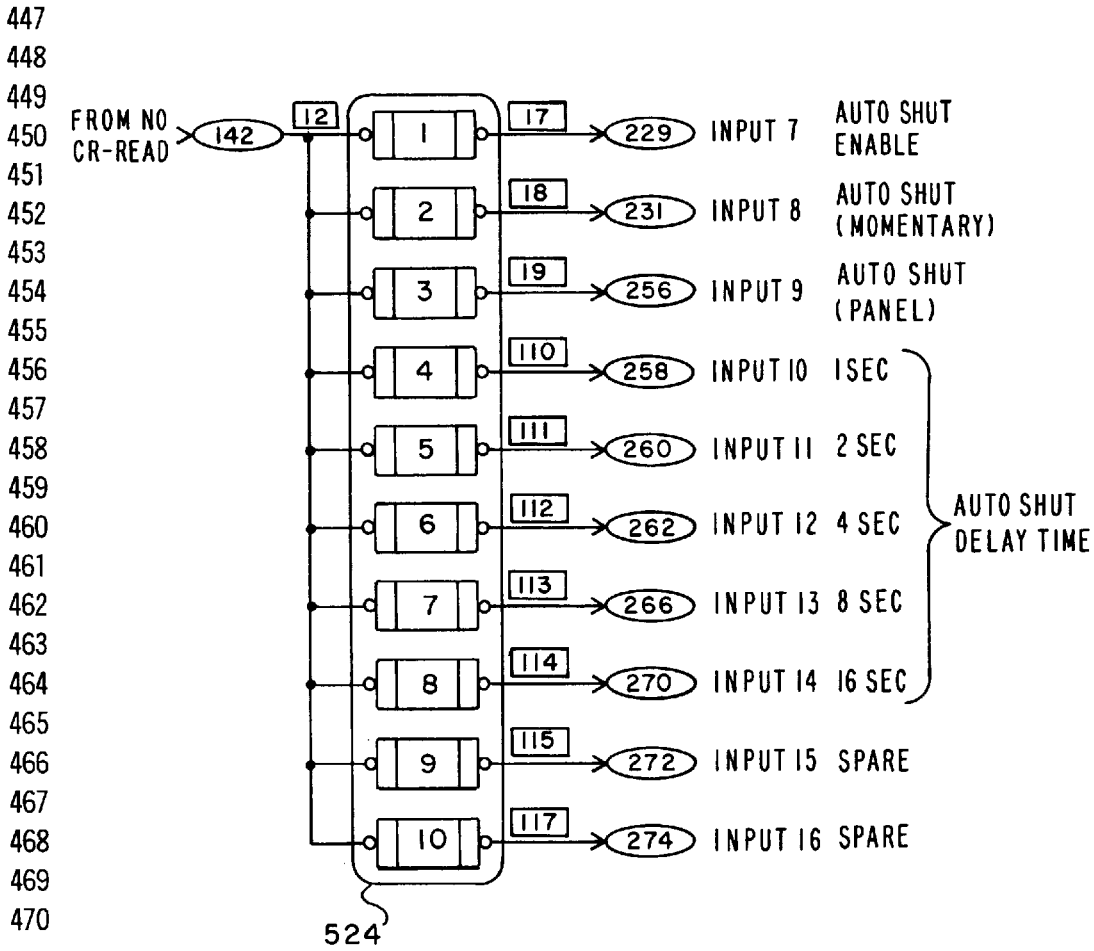

Referring briefly to FIG. 5G, the control system of the present invention includes a panel of settable switches (dual-in-line position or "DIP" switches), indicated generally at numeral 524 in FIG. 5G, and designated individually by numerals 1 through 10. Each of the switches in panel 524 is operable to be positioned to effect an automatic door closing operating cycle, if positioned as indicated by the legend in FIG. 5G. The automatic door closing delay time from a time commencing with opening of the door 10 may be set in accordance with the selected switch indicated in FIG. 5G. For example, depending on which switch or switches are selected, the automatic delay time for closing door 10 may be varied from one second to thirty-one seconds, as indicated. Once an automatic door shutoff mode has been selected a switch 526, FIG. 5A, is momentarily actuated to energize a control relay 527 which operates contacts 527*a* and 527*b* to enable the PLC 520 to read the current setting of the switches of the DIP switch panel 524 whereby the information furnished by the switches is stored in the PLC.

Referring to FIGS. 1 and 5B, a signal transmitter 528 is operably connected to the shaft 36 of motor 38 and may, for example, comprise a spur gear element 528*a,* see FIG. 1, with plural sensors 528*b* and 528*c* supported in proximity thereto and operable to effectively read the direction of rotation of shaft 36 and the rotative position of the roller or drum 22 and to provide a suitable signal to the PLC 520. In this way the position of the door closure member 24, within a very small incremental linear dimension, may be known at all times. By counting pulse signals generated by the sensor 528, the direction of movement and the position of the door closure member 24 between its open and closed positions may be read by the PLC 520. Referring to FIG. 5B, for example, the conductor 530 provides a pulse type signal to the PLC 520 and the number of pulses counted by the PLC is operable to indicate the door position from a reference starting point. The signal generator 528 furnishes two signals to the PLC 520 by way of conductors 530 and 534 to indicate the position of the door closure member 24 and direction of movement of the closure member.

A relay 536, FIG. 5A, is also operable to operate a contact 536*a,* FIG. 5B, to provide a signal to the PLC 520 from suitable proximity sensor means, not shown, which may include a transmitter, not shown, mounted on a vehicle which is to pass through the door 10. Any time such a vehicle is within a certain range of the door 10 a signal is received by the aforementioned sensors which effects closure of the contact 536*a* to cause the PLC to generate a signal to move the door to an open position. The control system may be operated such that when such vehicle moves out of range of the aforementioned sensor the door will automatically close.

The control system shown in FIGS. 5A through 5G also includes a manually actuatable stop switch 538, FIG. 5B, suitably mounted on a control panel disposed in proximity to the door 10 or at a desired location with respect to the door. When switch 538 is actuated the PLC 520 causes the drive motor 38 to immediately stop the door in whatever position it is in, upon receiving the signal. FIG. 5B also shows the circuit position of the sensor 80, which may, as described, be a photoelectric or photosensitive type to generate an input signal to the PLC 520 indicating that the closure member 24 has reached its upper limit position. Those skilled in the art will appreciate that the sensors 80 and 82, 83, although indicated as photoelectric type sensors, may be other types of proximity sensors or positive engagement type sensors which would be operable to engage a projection or contact element mounted on the closure member 24 or breakout bar 42. Moreover, by mounting sensors 80 and 82, 83 on the frame channel members 16 and 18 for linear adjustment therealong, the upper and lower limit positions of the door closure member 24 may be easily adjusted. Referring further to FIG. 5B, the aforementioned control panel for the door 10 is also operable to include manually actuatable door open and close switches 540 and 542 which are connected to the PLC 520 to cause the PLC to effect control over the drive motor 38 to open and close the door 10 on command.

The controller 100 includes an internal fault condition signal circuit which is operable to be connected to the PLC 520 by way of a contactor 544, FIG. 5C. When this contactor is in the open condition a signal to the PLC 520 indicates a fault condition in the motor drive 38. However, when a signal is supplied to the PLC 520 by way of the contactor 544 such a signal indicates that the operating condition of the drive motor 38 is normal. The control system may also include a suitable remotely located switch 546 for effecting door opening movement, such as from a remotely located pull cord, or any remote door opening actuator. A controller reset switch 548 is connected to the PLC 520 as indicated. When switch 548 is actuated the PLC 520 is configured for the teaching mode of operation of the door, to be described further herein. Switch 548 is actuated on initial setup of the door control system or in restarting the system after power has been interrupted. The switch 548 is also actuated to reset a door bottom bar breakout alarm circuit to be described further herein.

A relay contactor 550, FIG. 5C, is connected to an input terminal of the PLC 520 and receives a signal from one of the area sensors 92 and/or 94. When this relay is energized or turned "on" the PLC 520 does not allow the door 10 to close. Accordingly, when an object is detected in a predetermined zone in proximity to the door 10 the door closure member or curtain 24 is prevented from moving to the closed position.

Referring further to FIG. 5C, there is illustrated, schematically, the sensor 82, 83 and its connection to the PLC 520 for providing a signal indicating that the door closure member 24 has reached the bottom limit or "closed" position or an obstruction is in doorway 12. When a radiation beam 83*c* generated by sensor 82, 83 is interrupted a signal is imposed on terminal 113 of PLC 520, as indicated. As described above, the sensor 82, 83 is constructed somewhat different from the sensor 80 in that the sensor 82 includes a transmitter 82 and a receiver 83. The transmitter 82 is disposed on the frame or channel member 16 and the receiver 83 is disposed on the frame or channel member 18.

Referring still further to FIG. 5C, a relay contactor 89*a* is shown, which is responsive to actuation of switch 89, upon engagement of the bottom bar plate member 87 by an object in the doorway 12 or the floor 13, to cause the drive motor 38 to be deenergized, if moving the closure member 24 to the door closed position. Accordingly, upon engagement of the member 87 with an object as mentioned above to effect opening the contactor 89*a,* a signal is provided to the PLC 520 to effect operation of the drive motor 38 to stop and reverse the direction of movement of the door closure member 24 toward the open position. Still further, if either of the bottom bar breakouts switches 88 or 90 are actuated a suitable signal is delivered to the PLC 520 which also then commands the controller 100 to cause motor 38 to immediately arrest movement of the closure member 24. The PLC 520 is also operable to receive a door interlock signal from a suitable controller, not shown, to control operation of the door 10 in conjunction with operation of another door. For example, if contactor 554 is closed a signal to PLC 520 is provided so that the door 10 will not open if such other door is opened or, conversely, the door 10 will open when such other door is opened. Contactor 554 is interposed in the control circuit as shown in FIG. 5C and is responsive to a signal from a controller for such other door, indicating the position thereof.

Referring now to FIG. 5D, the PLC 520 is operable to provide output signals to a second door interlock circuit, if used, by way of conductor 558 and 560. The PLC 520 is also operable to provide control signals to the controller 100 by way of conductors 506 and 507 to effect operation of the drive motor 38 in one direction or the other, as indicated. Multiple drive motor speed command signals may also be provided from the PLC 520 to the controller 100 by way of conductors 508 and 509 so that more than one door operating speed may be selected, if desired. For example, a predetermined operating speed of motor 38 may be provided for operation in the closing mode, which speed is less than or greater than the door opening mode. A particular speed may also be selected for operation of the door in the initial or teaching mode for determining the door open and closed limit positions and a further speed may be selected for operation to move the closure member 24 toward the door closed position after a bottom bar breakout has occurred. Accordingly, if no output signal is received by the controller 100 from conductor 508 or 509, a predetermined door closure operating speed is indicated. If an output signal is received from the PLC 520 via conductor 508, then the controller 100 is operated to control the drive motor 38 to open the door at a preset "high" speed. Still further, if an output signal is received from the controller 100 by way of conductor 509 only, a preset slow closing speed is provided by the controller 100 and the drive motor 38, and if output signals are received by the controller 100 from both conductors 508 and 509, the drive motor is operated at a predetermined speed for setting the door limit switch shutoff signals, for example. A suitable counter 564 is also operable to be connected to the PLC 520 for monitoring the number of door opening and closing cycles.

Referring to FIG. 5E, the output terminal board for PLC 520 also includes a terminal which provides a signal to a relay 566 for causing the contactors 514 and 515, FIG. 5A, to open or close to set the electromechanical brake 39. Brake 39 must be energized to release. Accordingly, the PLC 520 provides a suitable signal to relay 566 to effect release of brake 39 only when command signals to controller 100 to energize motor 38 are in effect. An output signal may be conducted to a flashing beacon 568, which beacon is preferably located in a position of high visibility to warn of the door operating in the automatic closing mode. Additional visual indicators 570, 572, 574 and 576 may be provided on a control panel for the control system of the invention to indicate when the door 10 is operating in the automatic mode, when one of the area sensors 92 or 94 has been activated, when one of the bottom bar breakout switches 88 or 90 has been activated and when some other system fault condition exists.

The control circuit described hereinbefore and illustrated in FIGS. 5A through 5G provides several improvements in operating systems for rollup type doors. The door closure member 24 is under control at all times and does not coast in the up (opening) operating mode or down (closing) operating mode. The speed of the drive motor 38 may be adjusted, at will, thereby eliminating the need to utilize or provide an inventory of motors having different operating speeds or different mechanical linkages between the drive motor and the roller shaft or drum for the door closure member. The utilization of the type of PLC described herein provides for interfacing operation of the door 10 with other systems and, for example, provides the ability to interlock operation of the door 10 with other doors in, for example, an airlock type application. The use of the drive motor 38 and its controller 100 provides for the soft start and stop capability which results in less wear and tear on the drive motor and the door closure member. Mechanical brakes are used only to hold the door closure member in the limit positions and not to stop movement of the door. The door open and closed positions may be adjusted, at will, and redundancy is provided in control of the door limit positions. Moreover, the door closure member 24 may be controlled to move at a predetermined, reduced speed when being lowered to reengage the bottom bar and when being raised or lowered prior to setting the door up and down or "open" and "closed" limit positions.

Since opening and closing of the closure member 24 is limited by the distances defined by the location of the sensors 80 and 82, 83, these locations are also learned and stored in the memory of the PLC 520 during a "teach" mode of operation of the door 10. Door movement is also monitored by an internal timer circuit in the PLC 520. Once door movement has been initiated the closure member 24 will continue to move until either the door reaches a position sensed by a sensor 80 or 82, 83, the sensor 82, 83 senses an obstruction, the stop switch 538 is actuated, one of the switches 88, 89 or 90 is actuated, or one of the sensors 92 or 94 is actuated. If the door closure member 24 fails to stop at a normal point as determined by the sensors 80 or 82, 83, the signals generated by the signal generator 528 will cause the drive motor 38 to shut off after a predetermined count. Failing that, the aforementioned timer in PLC 520 will cause the PLC to operate controller 100 to shut off the drive motor 38 after a predetermined elapsed time from initiation of an opening or closing operation of the door. The door 10 may, of course, be operated by the switches 540, 542 and 538 independent of operation by a remote controller or proximity sensor.

The PLC 520 may be operated in conjunction with operation of the push button switches 526 and 538 by actuating the switch 538 for one second and then actuating the momentary or push button switch 526 while still actuating the switch 538. This allows the control system to cause the door 10 to enter a "jog mode". The opening or closing switches 540 and 542 may then be actuated to "jog" the closure member 24 between open and closed positions. Indicator 570 will flash when the system is in the "jog" mode. Switches 538 and 526 are again actuated in the same manner as described above to return the system to the normal operating mode.

If the door 10 is moved to the open position as a result of actuating the switch 540 or the switch 546, the PLC 520 can be programmed to automatically close the door after a predetermined time delay as set by the DIP switches on the panel 524, as indicated in FIG. 5G. Moreover, the PLC 520 may also be programmed to automatically close the door 10 after a predetermined time, once the door has opened, and in response to a door opening signal received from the proximity sensor (loop actuator) which activates the relay 536 and contact 536*a*.

To set up the automatic door close process, DIP switch No. 1 on panel 524 is preset and Switch No. 2 on panel 524 is set to close if the automatic close feature is operable to work with a momentary signal. DIP switch No. 3 must also be preset for the auto close feature to work when operating from the panel on which the DIP switches are located. DIP switches Nos. 4 through 8 on panel 524 are dedicated to time settings and when each switch is set that amount of time delay will be entered. The time settings can be added together for the total time delay, for example, a total time delay of twenty seconds may be obtained by setting switch No. 8 and switch No. 6.

If the switch 89 associated with the bottom edge sensor 84 is actuated the controllers 520 and 100 automatically cause the drive motor 38 to move the door to its fully open position. This action will occur also if the sensor 82, 83 indicates that an obstruction in the doorway 12 has interfered with radiation beam 83*c,* FIG. 1. Moreover, the area sensors 92 and 94 are also operable to stop movement of the door closure member 24 if any movement of an object in the predetermined zones surrounding the door occurs while the door is in operation. If the door closure member 24 is moving toward a closed position it will stop and automatically reverse to a fully open position.

If switches 88 or 90, FIG. 4, are actuated the drive motor 38 immediately shuts off and all door activation signals are disabled except for that provided by switch 542. Moreover, switch 540 may be operated if the closure member 24 is within a predetermined distance from the floor 13. The purpose of enabling the switches 540 and 542 is to facilitate lowering the door closure member 24 toward the floor 13 so that the bar 42 may be reconnected to the guide members 48 and 50. When the bar 42 has been reconnected the switch 526 must be momentarily actuated to place the system back into the automatic mode and to turn off any alarm indicators.

The PLC 520 is operable to determine how far to open and close the door closure member 24 by transmitting suitable control signals to the controller 100. Initially, when the door 10 is operated in the "teach" mode the closure member 24 is moved toward the open position from the closed position at a predetermined speed until the sensor 80 is activated. This gives the PLC 520 a count from the sensor 528 indicating the door upper limit position. In the "teach" mode the door closure member 24 then automatically proceeds in the downward direction, upon reaching the upward limit position, until it activates the sensor 82, 83 and the PLC 520 receives a predetermined count from the sensor 528 so that the PLC "learns" the door bottom position. The PLC 520 may be programmed to add a fixed distance to the amount of closing movement once a signal is received from the sensor 82, 83. If the closure member 24 is stopping too high off of the floor 13, the position of sensor 82, 83 is adjusted on the guide members 16 and 18, respectively. Prior to teaching the PLC 520 the new lower limit position of the door 10, switch 526 is momentarily actuated to clear the PLC circuitry and the teach mode for the open and closed positions of the closure member 24 is then carried out again.

If any one of the sensor 82, 83, the bottom edge sensor 84 or the various sensors 92 and 94 have been activated while the door closure member 24 is moving to the closed position, the indicator 582 will flash and the door will move to the open position. If the door 10 is already open the drive motor 38 is prevented from moving the closure member 24 toward the closed position until switch 538 is momentarily actuated.

The PLC 520 and the controller 100 may both be equipped with suitable indicators, not shown, indicating the status of these devices. For example, the PLC 520 may be provided with a visual indicator indicating that power is applied to the PLC circuitry, a visual indicator that indicates that the PLC is functioning properly or not and an indicator which signals that the PLC is on and is operable. The controller 100 may also include suitable visual indicators to determine whether or not the controller 100 is in an "on" and running condition, as well as visual indicators which signal certain faults such as that both "open" and "close" commands are being given to the controller simultaneously, that a "stop" command is given while open and close commands are also being given, that a motor overtorque condition is detected, and that low voltage or power conditions exist in the electrical energy supplied to the controller 100 and the drive motor 38. Indicators may also be provided which display a signal indicating overcurrent to the brake 39, that the power supply is over the recommended voltage, that the controller 100 is overheated and that certain faults exist based on settings for motor start, stop and speed.

The aforementioned control system may be implemented utilizing components which are suitable for operation on 100 volt to 240 volt AC electrical power at "normal" temperature and humidity conditions. The aforementioned drive motor 38, including the controller 100, is operable to be supplied with single phase or three phase AC power at 200 to 230 volts and 50 to 60 Hertz.

The fabrication and operation of the control system described above may be implemented by those of ordinary skill in the art based on the foregoing description read in conjunction with the drawing figures. Although a preferred embodiment of a control system for a rollup door and the method of operation have been described in detail herein those skilled in the art will also recognize that various substitutions and modifications may be made without departing from the scope and spirit of the appended claims.

What is claimed is:

1. In a rollup type door for forming a closure over a door opening, a flexible closure member supported on a rotatable drum member and operable to be rolled onto and off of said drum member for movement between door open and door closed positions, respectively, opposed guide means for said closure member and a closure member bottom bar connected to said closure member and operable to be releasably connected to said guide means for guiding said closure member for movement between door open and closed positions;

a variable frequency AC electric motor drivably connected to said drum member for rolling said closure member onto and off of said drum member for movement between door open and door closed positions;

a first controller operably connected to said motor and adapted to supply said motor with variable frequency AC electric power, said first controller being adapted to supply said motor with AC electric power at a selected range of variable frequencies during a starting phase of said motor and during a stopping phase of said motor to accelerate said closure member and decelerate said closure member when moving between open and closed positions, respectively;

a door open position sensor and a door closed position sensor;

a second controller operably connected to said first controller for transmitting door opening and closing command signals to said first controller, said second controller being operable to receive signals to effect starting of said motor in a selected direction of rotation to open and close said door from a source comprising one of a manually operated switch for effecting opening of said closure member and a manually operated switch for effecting closing of said closure member, said second controller being operable to cause said first controller to control stopping said motor in response to said second controller receiving a signal from at least one of said door open position sensor, said door closed position sensor, a sensor responsive to said bottom bar engaging a structure, and a sensor for determining when said bottom bar has become disconnected from said guide means;

said door open position sensor includes means disposed on said guide means adjacent to said closure member and responsive to said closure member moving to a predetermined position to initiate a signal to said second controller to cause said second controller to initiate a signal to said first controller to effect controlled deceleration and stopping of said motor in an open position of said closure member;

said door closed position sensor being operable to sense the position of a bottom edge of said closure member when said closure member has moved toward a closed position to cause said second controller to initiate a signal to said first controller to provide controlled deceleration and stopping of said motor in a closed position of said closure member; and another position sensor for determining the position of said closure member based on a predetermined number of revolutions of a shaft operably connected to one of said motor and said drum, said predetermined number of revolutions corresponding to movement of said door between its open and closed positions as determined by said door open and closed position sensors, respectively, said another position sensor being operable to cause said second controller to effect stopping said motor in response to a signal from said another position sensor corresponding to said predetermined number of revolutions.

2. The invention set forth in claim 1 including:

a brake operably connected to said motor and operable to prevent rotation of said shaft in response to stopping of said motor.

3. The invention set forth in claim 1 wherein:

said second controller comprises a programmable logic controller operable to be programmed to transmit signals to said first controller to cause said motor to effect closing of said door after a predetermined time delay in response to said door reaching an open position.

4. The invention set forth in claim 3 including:

a plurality of control switches operably connected to said second controller for causing said second controller to enable said first controller to effect operation of said motor to close said door, selected ones of said control switches being moveable to a position to preselect the amount of said time delay for initiating a signal to said first controller to energize said motor to close said door.

5. The invention set forth in claim 1 wherein:

said first controller includes means responsive to a signal from said second controller to effect operation of said motor at a first predetermined speed for opening said door and a second predetermined speed for closing said door.

6. The invention set forth in claim 5 wherein:

said second controller includes means operable to cause said first controller to effect operation of said motor at a predetermined speed during a teaching mode of operation of said door to determine limit positions of said door in the open and closed positions, respectively.

7. The invention said forth in claim 1 wherein:

said second controller includes a timer operable to cause said first controller to effect shutoff of said motor after a predetermined time commencing with operation of said motor to cause one of opening and closing of said door.

8. The invention set forth in claim 1 wherein:

said door closed position sensor is operable to provide a signal to said second controller to cause said second controller to prevent closing said door in response to detecting an obstruction in said door opening.

9. The invention set forth in claim 1 including:

at least one area sensor for determining the presence of an object within a predetermined area adjacent to said closure member, said area sensor being operable to cause said second controller to effect movement of said door toward an open position when said door is being operated to move toward a closed position.

10. The invention set forth in claim 1 including:

indicator means associated with said second controller for providing a signal indicating that said door is moving between open and closed positions.

11. The invention set forth in claim 1 including:

switch means for causing said controllers to effect one of opening and closing said rollup door in response to a signal associated with opening and closing of a second door spaced from said rollup door.

12. A method for operating a rollup type door comprising a flexible closure member supported on a rotatable drum member and operable to be rolled onto and off of said drum member for movement between door open and closed positions, respectively, said door including opposed guide means for said closure member and means for interconnecting said closure member with said guide means for guiding said closure member for movement between door open and closed positions, said door including a variable frequency AC electric motor drivably connected to said drum member for rolling said closure member onto and off of said drum member, a first controller operably connected to said motor and operable to energize said motor with variable frequency AC power during a starting phase of said motor, energize said motor with variable frequency AC electric power during a stopping phase of said motor and energize said motor at a selected frequency of AC electric power during at least one steady state operating phase between said starting and stopping phases upon at least one of opening and closing said door, and a second controller operably connected to said first controller for transmitting to said first controller door opening and closing command signals received from at least one of a door open position sensor, a door closed position sensor, and a position sensor for determining the position of said closure member based on a predetermined number of revolutions of a shaft operably connected to one of said motor and said drum, said predetermined number of revolutions corresponding to movement of said door between its open and closed positions as determined by said door open and closed position sensors, respectively, said method comprising the steps of:

preselecting a variable frequency starting phase for said motor and a variable frequency stopping phase for said motor and a selected operating frequency of said motor during a steady state operating phase between said starting phase and said stopping phase when said motor is energized to open and close said door, respectively;

causing said second controller to effect operation of said first controller to energize and deenergize said motor in response to a signal to said second controller from one of a manually operated switch for opening said door, a manually operated switch for closing said door and a remotely controlled switch for opening said door; and controlling deceleration and stopping of said motor in response to command signals received from at least one of said door open position sensor, said door closed position sensor, and said position sensor for determining the position of said closure member based on a predetermined number of revolutions corresponding to movement of said door between its open and closed positions as determined by said door open and closed position sensors, respectively.

13. The method set forth in claim 12 including the step of:

causing said second controller to command said first controller to effect closing of said door after a predetermined time commencing with deenergization of said motor upon moving said door to an open position.

14. The method set forth in claim 12 including the step of:

generating a signal for retention by said second controller by said sensor for determining the position of said closure member based on said predetermined number of revolutions of said shaft and corresponding to the number of revolutions required to move said closure member from a closed position to an open position.

15. The method set forth in claim 14 including the step of:

generating a signal for retention by said second controller by said sensor for determining the position of said closure member based on said predetermined number of revolutions of said shaft and corresponding to the number of revolutions required to move said closure member from said open position to said closed position.

16. The method set forth in claims 14 or 15 including the step of:

causing said second controller to effect operation of said first controller to deenergize said motor in response to receiving a signal by said second controller from said sensor for determining the position of said closure member based on said predetermined number of revolutions corresponding to one of a closed position and open position of said closure member.

* * * * *